US005561342A

United States Patent [19]

Roeder et al.

[11] Patent Number: 5,561,342

[45] Date of Patent: Oct. 1, 1996

[54] ELECTRON BEAM EXIT WINDOW

[75] Inventors: Olaf Roeder; Ulf Seyfert; Siegfried Panzer, all of Dresden, Germany

[73] Assignee: Fraunhofer-Gesellschaft zur Foerderung der angewandten Forschung e.V., Munich, Germany

[21] Appl. No.: 351,401

[22] PCT Filed: May 3, 1993

[86] PCT No.: PCT/DE93/00402

§ 371 Date: Feb. 17, 1995

§ 102(e) Date: Feb. 17, 1995

[87] PCT Pub. No.: WO93/26032

PCT Pub. Date: Dec. 23, 1993

[30] Foreign Application Priority Data

Jun. 15, 1992 [DE] Germany ..... 42 19 562.4

[51] Int. Cl.[6] ..... H01J 33/00

[52] U.S. Cl. ..... 313/420; 313/359.1

[58] Field of Search ..... 313/359.1, 420; 250/492.3, 505.1

[56] References Cited

U.S. PATENT DOCUMENTS

| | | | |
|---|---|---|---|
| 3,162,749 | 12/1964 | Peracchio . | |
| 3,222,558 | 12/1965 | Hueschen . | |
| 4,324,980 | 4/1982 | Symmons | 250/505 |
| 4,494,036 | 1/1985 | Neukermans | 313/420 |
| 4,591,756 | 5/1986 | Avnery | 313/420 |
| 4,855,587 | 8/1989 | Creusen et al. . | |
| 5,210,426 | 5/1993 | Itoh et al. | 250/492.3 |

FOREIGN PATENT DOCUMENTS

| | | |
|---|---|---|
| 0195153 | 9/1986 | European Pat. Off. . |
| 1800663 | 6/1969 | Germany . |
| 1918358 | 10/1969 | Germany . |
| 102511 | 12/1973 | Germany . |
| 2501885 | 7/1976 | Germany . |
| 207521 | 3/1984 | Germany . |

OTHER PUBLICATIONS

*IEEE Trans. on Plasma Science* entitled "Performance Improvements With Advanced Design Foils in High–Current Electron Beam Diodes" by R. Shurter et al., Bd. 19, Nr. 5, Oct. 1991, pp. 846–849.

*Nucl. Instrum. and Meth. in Phys. Research* entitled "Long–Lif Carbon–Fiber–Supported Carbon Stripper Foils" by M. J. Borden et al., Bd. A303, 1991, pp. 63–68.

*Primary Examiner*—Sandra L. O'Shea
*Assistant Examiner*—Mack Haynes
*Attorney, Agent, or Firm*—Evenson, McKeown, Edwards & Lenahan, P.L.L.C.

[57] ABSTRACT

An electron beam exit window, known as Lenard window, has a beam exit opening which is closed in a vacuum-tight manner by a metal foil. Resting on the metal foil on the vacuum side is a supporting grid of heat-proof fiber bundles. The supporting grid is fixed in a frame. The electron beam exit window is particularly suitable for relatively low electron energies with a high power density of the electron beam. This provides an easily manufactured window with low absorption.

16 Claims, 2 Drawing Sheets

ELECTRON BEAM EXIT WINDOW

BACKGROUND OF THE INVENTION

The invention relates to an electron beam exit window through which an electron beam generated in an evacuated electron gun passes out into an area of higher pressure, preferably to atmospheric pressure. Such beam exit windows, also known as Lenard windows, are mainly used in electron beam installations in which an electron beam process, such as, e.g. an electron beam polymerization, is performed in an area under atmospheric pressure. The electron beam can be generated in the form of an axial beam which can be moved by scanners over the beam exit window and can be passed through the beam exit window in the form of a ribbon-like or laminar-generated electron beam.

Numerous differently designed apparatuses are known for passing out electron beams to the free atmosphere. The simplest known constructions comprise a thin, gas-impermeable foil, which separates the beam generating chamber from the free atmosphere in vacuum-tight manner. These foils are preferably made from aluminum, titanium or beryllium alloys. During the passage of the electron beam, the foil is heated due to unavoidable interaction between the electron beam and the foil material. The foils must withstand the pressure difference, but must not be so thick that on the one hand they limit the energy losses of the electron beam to be passed out and on the other the power dissipation to be removed from the foil. This is so that the foil heating remains within a temperature range acceptable for the foil material (U.S. Pat. No. 3,222,558). In the simplest case, a gas flow is used for heat removal purposes.

It is also known to successively arrange in a spaced manner in the beam direction a number of thin foils in such a way that individual zones, sealed against the beam generating chamber and the atmosphere, are formed. Through the zones, a cooling gas is passed in such a way that, between the beam generating chamber and the atmosphere, the pressure difference is divided up over the individual zones, in that the average static pressure increases from one zone to the next. The sum of the thicknesses of the individual foils corresponds at least to the thickness of one foil of a beam exit window having only a single foil (East German Patent document 102,511; U.S. Pat. No. 3,162,749). As the minimum possible foil thickness is limited by the manufacturing capability for vacuum-tight foils, and the absorption of the individual foils is summated, the absorption losses are very high. This is true particularly when working with a relatively low accelerating voltage. There is the further disadvantage that the necessary, considerable curvature of the foils, particularly in the window edge area, leads to higher absorption rates due to the inclined incidence of the beam.

In other known designs, use is made of mechanical supporting structures for limiting tensile stresses in the foil. The recesses in these supporting structures are arranged close together and in part are conically directed towards the vacuum side so that the webs supporting the foil are tapered between the recesses on the vacuum side (East German Patent document 207,521, German Patent document DE-OS 18 00 663). Thus, the electrons striking the surfaces of the supporting structure are reflected without a complete energy loss and, subsequently, at least partly pass out of the window. However, even a supporting structure designed in this manner suffers from the shortcoming that the reduction of the effective electron passage surface and, therefore, the additional power loss of the electron beam due to the supporting structure, can be 30% and higher. There is also the further disadvantage that the thermal loading of the supporting structure is very high and, consequently, high demands are made on the thermal conduction and heat dissipation. Frequently, use is made of supporting structures through which flows cooling water, but these structures require larger supporting lamellas. However, due to the resulting shadows that are cast, a disadvantageous effect can occur on the homogeneity of the irradiation field behind the window (German Patent document DE-OS 19 18 358).

Attempts have also been made to reduce the indicated deficiencies of known supporting structures in that, apart from a special geometrical design, the irradiatcd surfaces are polished and coated with elements having high atomic numbers (European Patent EP 195 153). However, these measures are also unable to solve the above-described deficiencies. In addition, the construction of such a supporting structure is very complicated.

All of the above-described designs containing a supporting structure suffer from the disadvantage that the spacing between the beam exit window and the irradiation material must be increased in order to reduce the influence of the cross-section of the lamellas oil the homogeneity of the irradiation field. However, this leads to increased losses in the gas path between the exit window and the irradiation material, which in particular with relatively low accelerating voltages has a disadvantageous effect on the available irradiation depth and power dose density.

There is therefore needed an electron beam exit window of the above-mentioned type, which does not require a solid, water-cooled supporting structure, that has a low power absorption, particularly for electron beams with a relatively low accelerating voltage, and which is easy to manufacture.

These needs are met according to the present invention by an electron beam exit: window including a frame for providing a vacuum-tight connection to an electron beam generator, a vacuum-tight metal foil which is permeable to the electron beam, and a supporting structure for the metal foil. On the vacuum side, a supporting grid of fiber bundles made from heat-proof material, rests on the metal foil. The supporting grid is clamped in the frame. The metal foil is arranged in a vacuum-tight manner on the frame.

The supporting of the metal foil by the supporting grid formed from heat-proof fiber bundles and the tensile stressing of the fiber bundles allow a cross-sectional minimization of the supporting grid structure and, therefore, a significant reduction in the beam losses in the beam exit window. The use of carbon fiber bundles for the supporting grid is particularly advantageous due to the low, elastic expansion and the low temperature expansion coefficient. A roughly circular cross-section of the fiber bundles is ensured, even under loading, for example, brought about by twisting of the filaments. The use of fiber bundles made from a heat-proof material makes it possible to maintain a high temperature gradient over the supporting grid in the beam direction. It also makes possible the removal of a significant part of the beam power absorbed in the supporting grid by heat radiation when using a metal foil made from titanium and carbon fiber bundles as the supporting grid, it is appropriate to provide the metal foil on the vacuum side with a barrier layer, preferably of titanium dioxide. This is done in order to avoid chemical reactions between the supporting grid material and the metal foil. A similar barrier layer can also be appropriate on the pressure side of the foil, in order to avoid the undesired diffusing in of the gaseous contact partners of the metal foil.

The fiber bundles form an angle with the fixing frame which is not equal to 90°. Through an appropriate adaptation of this angle to the window width, the reciprocal spacing of the fiber bundles and the power density distribution of the electron beam, the irradiation homogeneity on the moving irradiation material is improved. The metal foil can also be cooled on the pressure side in a known manner by a gas flow, preferably in the direction of the fiber bundles.

The beam exit window according to the present invention is particularly suitable for relatively low-energy electron beams wherein there is a limited distance between the beam exit window and the irradiation material.

Other objects, advantages and novel features of the present invention will become apparent from the following detailed description of the invention when considered in conjunction with the accompanying drawings.

DETAILED DESCRIPTION OF THE DRAWINGS

Figure 1:
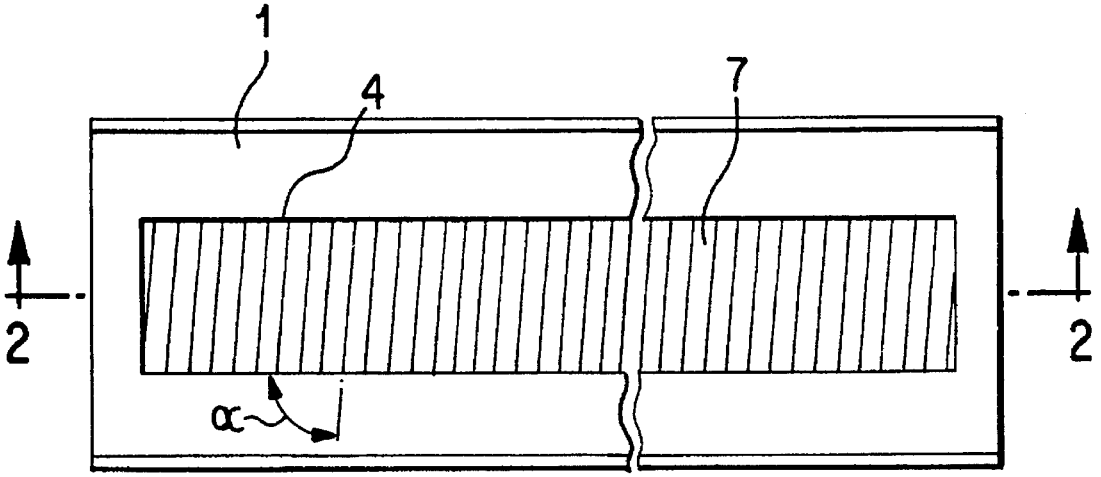
FIG. 1 is a plan view of a frame with a supporting grid of an electron beam exit window according to the invention.
Figure 2:
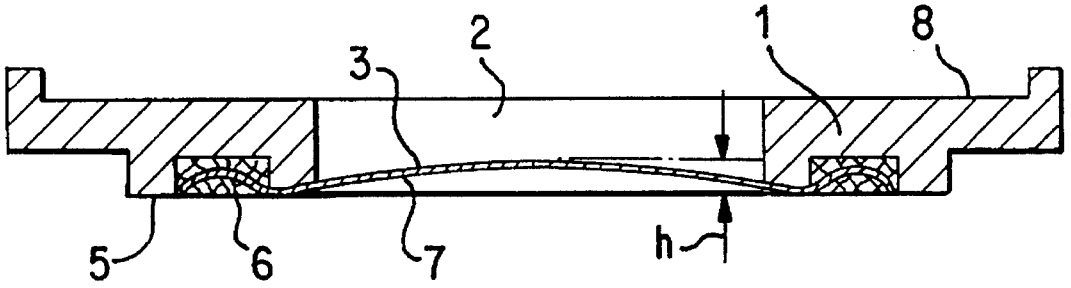
FIG. 2 is a sectional view through an electron beam window according to the invention.

The electron beam exit window according to FIGS. 1 and 2 includes the frame 1 with the opening 2 for the beam exit. The opening area is covered by a supporting grid 3 including carbon fiber bundles 4. The fiber bundles 4 are integrally anchored in grooves 5 by a filling cast resin 6. A titanium metal foil 7 resting on the supporting grid 3 is bonded onto the frame 1. The fiber bundles 4 of the supporting grid 3 are arranged at an angle $\alpha<90°$ with respect to a leg of the frame 1 for improving the homogeneity of the irradiation. On the other side of the supporting grid 3, the frame 1 has a sealing surface 8. The sealing surface 8 engages in a vacuum-tight manner on an electron beam generator (not shown).

in order to limit the tensile stress in the fiber bundles 4, the latter have an amount of sag h. Under the action of the pressure difference applied, the metal foil 7 engages on the supporting grid 3. In order to ensure an approximately circular shape of the fiber bundles 4, even under loading by the metal foil 7, the bundles 4 are twisted.

Figure 3:
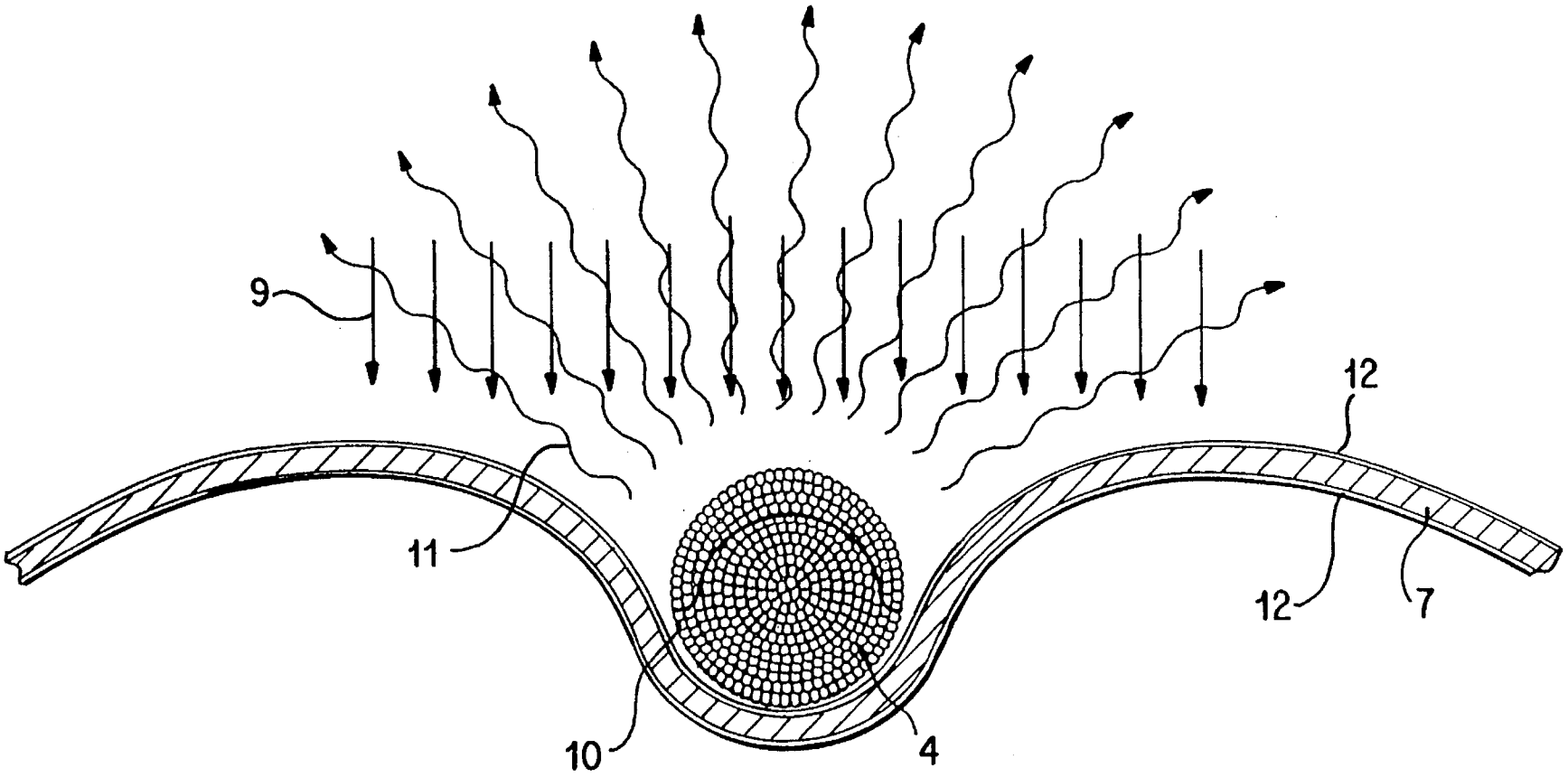
FIG. 3 is an enlarged partial sectional view through a fiber bundle with the metal foil according to the invention.

Referring to FIG. 3, the electron beams 9 exiting the electron beam generator are shown impacting on both the metal foil 7 and on the fiber bundles 4 of the supporting grid 3. Whereat the electron beams 9 penetrate the metal foil 7, accompanied by an energy loss, the beam power striking the fiber bundle 4 is almost completely absorbed by the latter and converted into heat. The heat formation point is, as a function of the electron energy, limited to the beam-side periphery 10 of the fiber bundle 4. As a result of the poor thermal conduction over the cross-section of the fiber bundle 4 and the metal foil 7 cooled by a gas flow on the pressure side there is a high temperature gradient over the cross-section. Therefore, a large part of the power absorbed in the fiber bundles 4 is irradiated in the opposite direction to the electron beams 9. The comparatively good thermal conduction of the metal foil 7 means that the latter engaging on the individual fibers of the bundle 4 has a roughly constant temperature over its cross-section, A titanium dioxide barrier layer 12 is applied to both sides of the metal foil 7 in order to reduce chemical reactions between the supporting grid material, as well as the gaseous reactants and the metal foil.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An electron beam exit window for use with an electron beam generator which generates an electron beam, comprising:

a frame connected to the electron beam generator in a vacuum-tight manner;

a vacuum-tight metal foil which is permeable to the electron beam;

a supporting structure for said metal foil;

a supporting grid formed of fiber bundles made of a heat-proof material which rests on a vacuum side of said metal foil, said supporting grid being clamped in said frame, and said metal foil being arranged in a vacuum-tight manner on said frame.

2. An electron beam exit window according to claim 1, wherein the fiber bundles comprise carbon filaments, said filaments being twisted.

3. An electron beam exit window according to claim 1, wherein the fiber bundles are bound with carbon.

4. An electron beam exit window according to claim 1, wherein the fiber bundles are either integrally or positively connected with a clearly defined sag to the frame.

5. An electron beam exit window according to claim 4, further comprising grooves arranged in the frame, the fiber bundles being inserted in the grooves, said grooves being subsequently closed with cast resin.

6. An electron beam exit window according to claim 1, wherein the fiber bundles are arranged either parallel to one another or crosswise to one another in the frame.

7. An electron beam exit window according to claim 6, wherein the fiber bundles are arranged at an angle $\alpha$, not equal to 90°, to an edge of the frame.

8. An electron beam exit window according to claim 1, wherein the frame is made from carbon fiber-reinforced carbon.

9. An electron beam exit window according to claim 1, wherein the frame is made from metal.

10. An electron beam exit window according to claim 1, wherein the frame is constructed so as to constitute a sealing component connecting with sealing faces of the electron beam generator.

11. An electron beam exit window according to claim 1, wherein the metal foil is made from either titanium or a titanium alloy.

12. An electron beam exit window according to claim 1, wherein surfaces of the metal foil are applied barrier layers acting as a diffusion barrier.

13. An electron beam exit window according to claim 12, wherein for carbon fiber bundles and a titanium metal foil, the barrier layer is made of titanium dioxide.

14. An electron beam exit window according to claim 1, wherein the metal foil is bonded in a vacuum-tight manner to the frame.

15. An electron beam exit window according to claim 14, further comprising a cover for protecting a bonding area from entry by backscattered electrons.

16. An electron beam exit window according to claim 1, further comprising means for producing a cooling gas flow provided in a vicinity of a pressure side of the metal foil.

* * * * *